US011167516B2

(12) United States Patent
Concilla

(10) Patent No.: US 11,167,516 B2
(45) Date of Patent: Nov. 9, 2021

(54) HANDHELD MODULAR ROSIN PRESS DEVICE

(71) Applicant: Steve Concilla, Columbus, OH (US)

(72) Inventor: Steve Concilla, Columbus, OH (US)

( * ) Notice: Subject to any disclaimer, the term of this patent is extended or adjusted under 35 U.S.C. 154(b) by 0 days.

(21) Appl. No.: 16/758,015

(22) PCT Filed: Oct. 24, 2018

(86) PCT No.: PCT/US2018/057371

§ 371 (c)(1),
(2) Date: Apr. 21, 2020

(87) PCT Pub. No.: WO2019/084180

PCT Pub. Date: May 2, 2019

(65) Prior Publication Data

US 2020/0316894 A1 Oct. 8, 2020

Related U.S. Application Data

(60) Provisional application No. 62/577,137, filed on Oct. 25, 2017.

(51) Int. Cl.
*B30B 9/04* (2006.01)
*B25B 5/06* (2006.01)
(Continued)

(52) U.S. Cl.
CPC ..... *B30B 9/04* (2013.01); *B25B 5/068* (2013.01); *B25B 5/163* (2013.01); *B30B 15/064* (2013.01)

(58) Field of Classification Search
CPC .. B30B 9/04; B30B 9/02; B30B 9/042; B30B 9/045; B30B 9/06; B30B 15/064;
(Continued)

(56) References Cited

U.S. PATENT DOCUMENTS 984,673 A * 2/1911 House ..... A47G 25/72 38/71
2,820,495 A * 1/1958 Wetzler ..... B25B 5/16 100/320

(Continued)

FOREIGN PATENT DOCUMENTS

CN 102910319 A 2/2013
JP 2001001376 A * 1/2001

OTHER PUBLICATIONS

GanjajuanaMan. 'Rosin Press: A look at my DIY bench vice rosin press' . YouTube, Mar. 8, 2017, [video online], [retrieved on Dec. 11, 2018]. Retrieved from the Internet: <URL: https://www.youtube.com/watch?v=iFRsKPeic_w&t=116s>.

(Continued)

*Primary Examiner* — Teresa M Ekiert
*Assistant Examiner* — Sarkis A Aktavoukian
(74) *Attorney, Agent, or Firm* — Tyler Dunham, Esq.

(57) ABSTRACT

The embodiments herein provide a modular rosin press device for use with a base clamp device having a pair or opposing rectangular elements, the modular device having a proximal press assembly, distal press assembly, and proximal block assembly. Each press assembly preferably contains a metallic heating component with a channel sized to accept the rectangular elements of the base clamp device. Each press assembly may also include a heating element, insulating plate, ledges which extend inwardly, and ribs of various designs and orientations.

10 Claims, 13 Drawing Sheets

(51) Int. Cl.
*B25B 5/16* (2006.01)
*B30B 15/06* (2006.01)

(58) Field of Classification Search
CPC ..... B30B 15/062; B30B 15/34; B30B 15/06; B30B 15/00; B25B 5/068; B25B 5/067; B25B 5/085; B25B 5/082; B25B 5/125; B25B 5/127; B25B 5/163; B25B 3/00; B25B 5/00; B23K 37/04; B23K 11/364
USPC ..... 269/6, 3, 95, 143
See application file for complete search history.

(56) References Cited

U.S. PATENT DOCUMENTS 4,736,507 A * 4/1988 Berecz ..... B25B 5/125 29/243.53
6,173,718 B1 * 1/2001 Okumoto ..... A45D 1/04 132/224
6,412,767 B1 * 7/2002 Beckmann ..... B25B 5/102 269/166
2002/0190047 A1 * 12/2002 Nam ..... A45D 1/04 219/222
2008/0035167 A1 * 2/2008 Chan ..... A45D 1/04 132/225
2009/0260651 A1 * 10/2009 Chan ..... A45D 1/06 132/269
2014/0007470 A1 * 1/2014 Mohamad ..... D06F 71/34 38/16
2017/0100881 A1 * 4/2017 Sayers ..... B29C 65/2061

OTHER PUBLICATIONS

HrBN Life. 'How to make a Rosin press'. YouTube. Jan. 19, 2016, [video online], [retrieved on Dec. 11, 2018] . Retrieved from the Internet: <URL: https://www.youtube.com/watch?v=59eZleJMZOI &has _verified=1>.
International Search Report for PCT/US18/57371, ISA/USPTO, dated Dec. 27, 2018, pp. 1-10.

* cited by examiner

HANDHELD MODULAR ROSIN PRESS DEVICE

CROSS-REFERENCE TO RELATED APPLICATIONS

This application claims priority to and is a National Stage filing of PCT Application PCT/US18/57371 filed on Oct. 24, 2018 which claims priority to U.S. Provisional Application No. 62/577,137 filed on Oct. 25, 2017, all of which are herein incorporated by reference in their entirety.

TECHNICAL FIELD

Embodiments generally relate to chemical-free rosin pressing.

BACKGROUND OF THE ART

Heat presses are generally used to extract oils from plants, and sometimes these heat presses are referred to as rosin presses.

SUMMARY OF THE EXEMPLARY EMBODIMENTS

Exemplary embodiments provide a modular system of rosin press components which provide accurate and consistent heat along with adequate pressure to extract the most oil possible, in the quickest amount of time, and in the easiest way for the user. The components can be installed on a base device, while permitting the base device to be replaced with a new base device, allowing the user to continue using the same module rosin press components, even though the base device has failed. Also, individual pieces of the assembly can be removed/replaced one at a time as each part fails. The exemplary embodiments permit use of the device with only one hand, making processing oils and concentrates much easier, especially when working alone. Thus, the exemplary embodiment of the rosin press components, once installed on a base device, are lightweight and easy to install/remove, but also provide enough strength for the high pressures and forces necessary to remove the oils.

The foregoing and other features and advantages of the present invention will be apparent from the following more detailed description of the particular embodiments, as illustrated in the accompanying drawings.

BRIEF DESCRIPTION OF THE DRAWINGS

A better understanding of an exemplary embodiment will be obtained from a reading of the following detailed description and the accompanying drawings wherein identical reference characters refer to identical parts and in which.

DETAILED DESCRIPTION

Figure 1A:
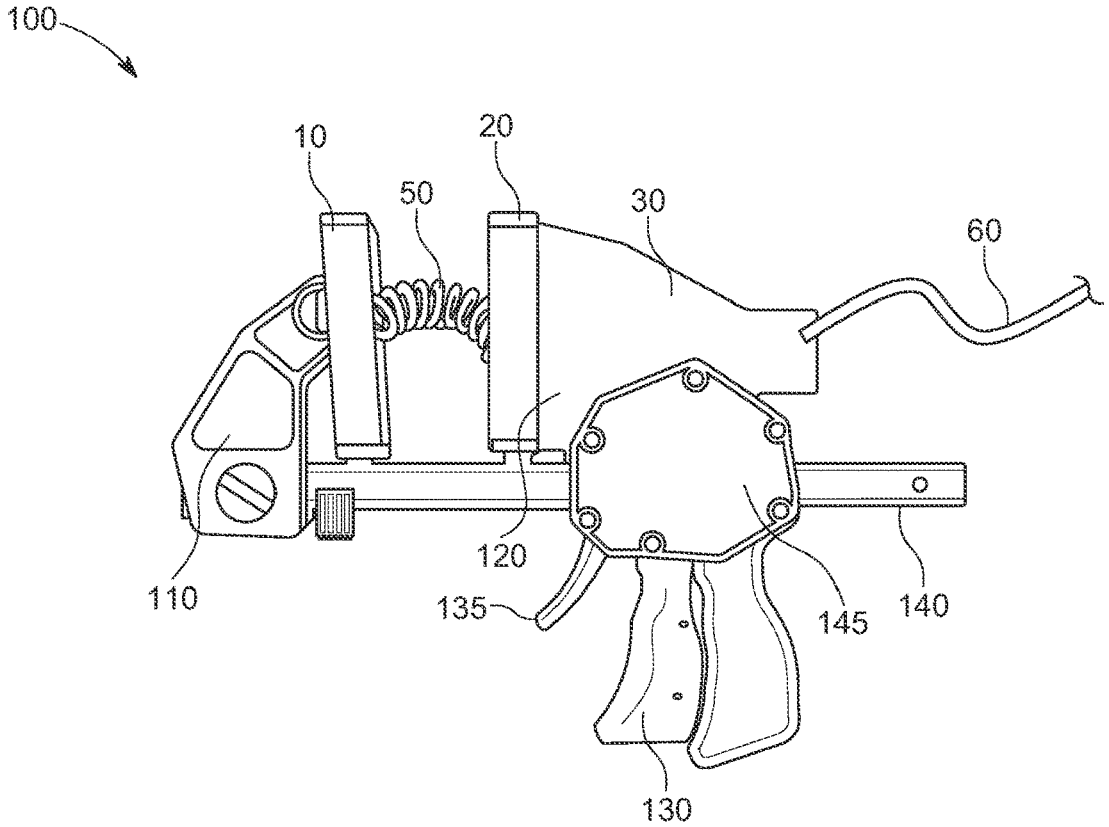
FIG. 1A is a front elevation view of an exemplary embodiment of the modular rosin press components attached to a base clamping device, where the clamp is open.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1A is a front elevation view of an exemplary embodiment of the modular rosin press components attached to a base clamping device 100, where the clamp is open. The modular rosin press components essentially comprise a distal press assembly 10 which is opposite a proximal press assembly 20 and a proximal block assembly 30 which is sized to surround at least a portion of the base clamping device 100 which is above the clamping mechanism 145. The proximal press assembly 20 is preferably fastened to the proximal block assembly 30.

In this embodiment, the base clamping device 100 includes a distal block 110 which is fixed to a rigid member 140 (such as a metal I beam). The rigid member 140 slides through the clamping mechanism 145 which is generally fixed relative to the proximal press assembly 20 as well as the proximal block assembly 30. As the rigid member 140 slides towards the clamping mechanism 145, the distal press assembly 10 moves towards the proximal press assembly 20. Squeezing the trigger 130 will cause the distal press assembly 10 to move towards the proximal press assembly 20 while squeezing the locking lever 135 will generally hold the position of the press assemblies 10/20 relative to one another.

The distal press assembly 10 is preferably electrically connected with the proximal press assembly 20 through the intermediary electrical conductor 50, while the overall device obtains power through the power cord 60, where either connection can be either removably electrically connected or permanently hard-wired to the printed circuit board (PCB) 36.

Figure 1B:
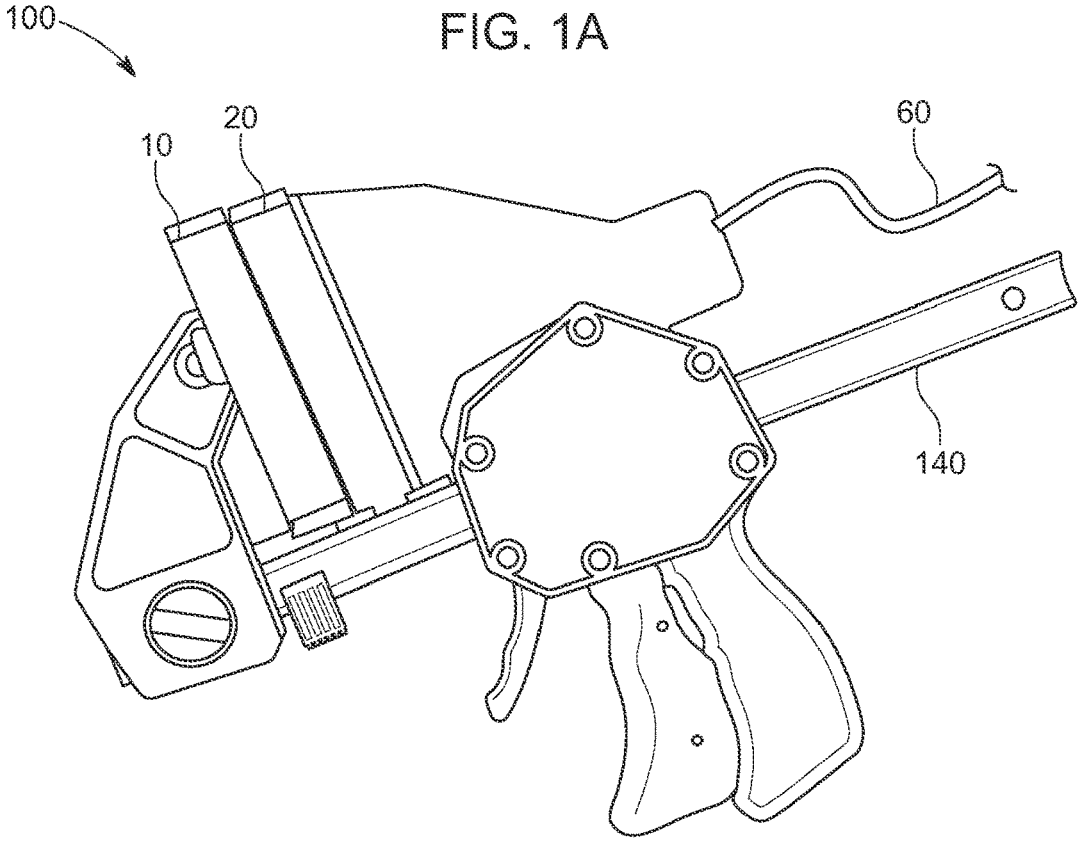
FIG. 1B is a front elevation view of the embodiment shown in FIG. 1A, where the clamp has been closed.

FIG. 1B is a front elevation view of the embodiment shown in FIG. 1A, where the clamp has been closed (the distal press assembly 10 has travelled towards the proximal press assembly 20 until the two components contact one another).

Figure 2:
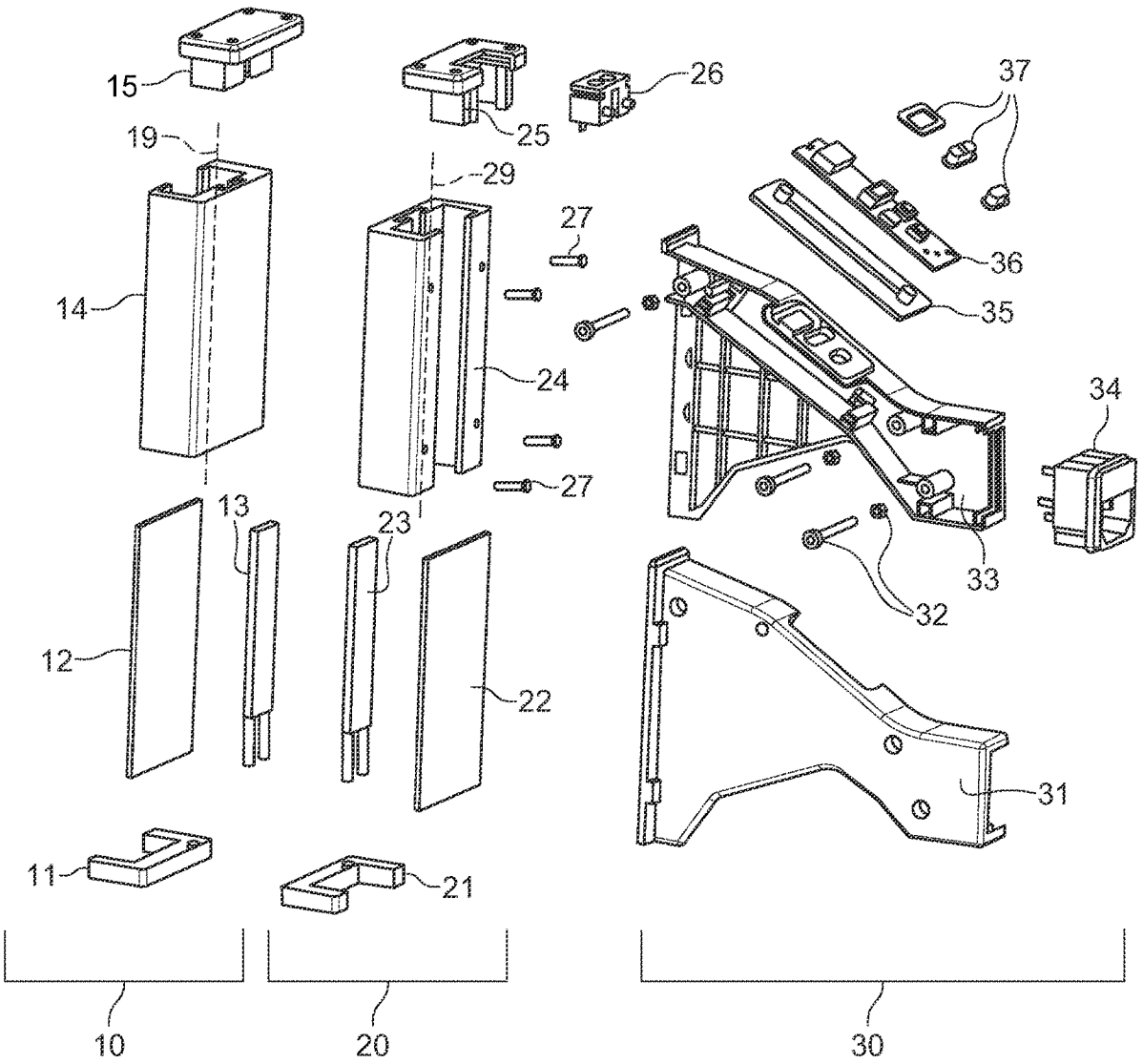
FIG. 2 is an exploded view of the exemplary embodiment of the modular rosin press components shown in FIG. 1A.

FIG. 2 is an exploded view of the exemplary embodiment of the modular rosin press components shown in FIG. 1A. First, the distal press assembly 10 generally comprises a heating element 13 which is inserted into a metallic heating component 14 and covered by an insulating plate 12. A top cap 15 is preferably fastened to the top portion of the metallic heating component 14 while a bottom cap 11 is preferably fastened to the bottom portion of the metallic heating component 14. Generally, the top cap 15 and bottom cap 11 are fastened to the metallic heating component 14 with threaded fasteners which pass through apertures 200/201 and thread into the threaded holes 300 in the metallic heating component 14. The axis for each of the threaded holes 300 is preferably substantially parallel to the longitudinal central axis 19 of the metallic heating component 14. The axis 19 runs down the center of a channel defined by the metallic heating component 14.

Second, the proximal press assembly 20 generally comprises a heating element 23 which is inserted into a metallic heating component 24 and covered by an insulating plate 22. A top cap 25 is preferably fastened to the top portion of the metallic heating component 24 while a bottom cap 21 is preferably fastened to the bottom portion of the metallic heating component 24. Generally, the top cap 25 and bottom cap 21 are fastened to the metallic heating component 24 with threaded fasteners which pass through apertures in the caps 21/25 and thread into the threaded holes 300 in the metallic heating component 24. The axis for each of the threaded holes 300 is preferably substantially parallel to the longitudinal central axis 29 of the metallic heating component 24. The axis 29 runs down the center of a channel defined by the metallic heating component 24.

Third, the proximal block assembly 30 is generally comprised of a left side 31 and right side 33 which combine using fasteners 32 to define an enclosed area that is sized to surround a portion of the base clamp 100 which is located in between the clamping mechanism 145 and the substantially flat rectangular element 190, this area is generally referred to as the proximal block 120 portion of the base clamp. The proximal block assembly 30 preferably slides over the proximal block 120 of the base clamp 100 by using an open bottom portion which allows it to be easily installed on top of the proximal block 120 while leaving the proximal block assembly 30 fully assembled and sometimes remaining assembled with the proximal press assembly 20 as well. This will be explained further below.

The metallic heating component 24 preferably contains a set of threaded holes which are generally perpendicular to axis 29 and accept the threaded fasteners 27 which pass through apertures on the left and right sides 31/33 of the housing in order to attach the proximal block assembly 30 to the proximal press assembly 20. The assembly 30 preferably contains a PCB mounting surface 35 along with a PCB 36 and one or more user interface elements 37 (ex. Switches, dials, displays, buttons, etc.) which are physically/electrically engaged with the PCB 36.

An optional main power connector 34 is placed within the assembly 30 and provides a removable electrical connection with the power cord 60 to provide the power input for the device. An intermediary power connector 26 is located within an aperture in the top cap 25 and is capable of being removably electrically connected with a plug on the end of the intermediary electrical conductor 50. Alternatively, these connections could each be hard wired with one another, with no use of plugs for removable electrical connections.

Figure 3:
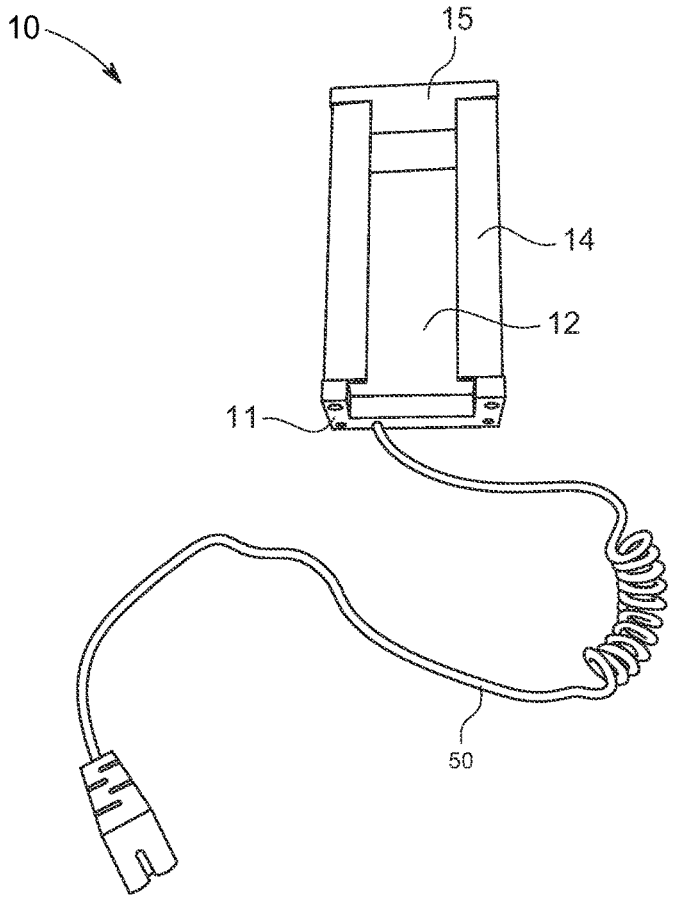
FIG. 3 is a left elevation view of an exemplary embodiment of the distal press assembly prior to being assembled with the base device.

FIG. 3 is a left elevation view of an exemplary embodiment of the distal press assembly 10 prior to being assembled with the base device 100. In this embodiment, the intermediary electrical conductor 50 is hard wired to the heating element 13 in the distal press assembly 10 while being removably electrically connected to the intermediary power connector 26 through a plug.

Figure 4:
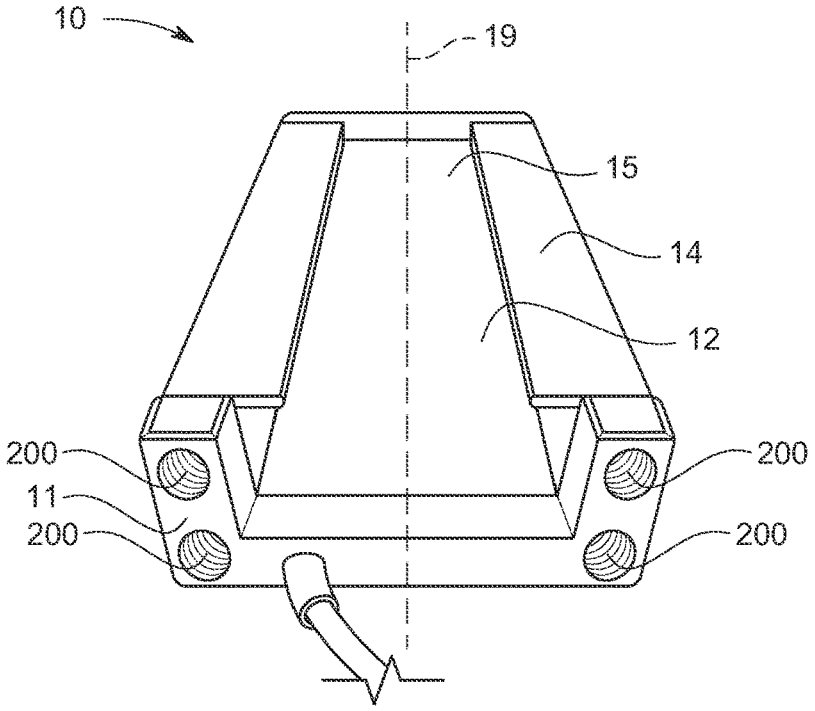
FIG. 4 is a bottom perspective view of the distal press assembly shown in FIG. 3.

FIG. 4 is a bottom perspective view of the distal press assembly 10 shown in FIG. 3. To attach the bottom cap 11 to the metallic heating component 14, threaded fasteners may pass through apertures 200 and thread into the threaded holes 300 in the metallic heating component 14. The bottom cap 11 preferably has a U-shape with the axis 19 running generally down the center of the U-shape. This U-shape is continued up the distal press assembly 10 through the general U-shape of the metallic heating component 14 as well.

Figure 5:
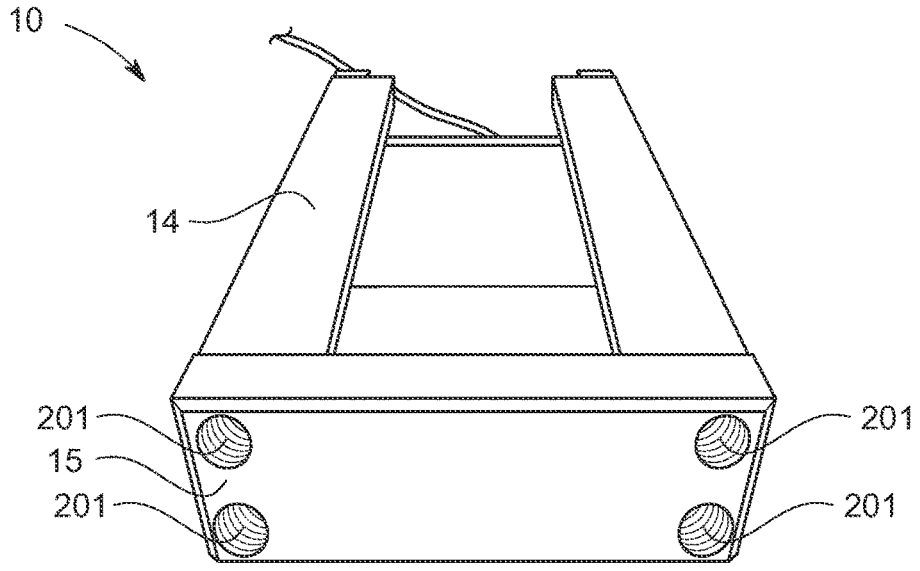
FIG. 5 is a top perspective view of the distal press assembly shown in FIG. 3.

FIG. 5 is a top perspective view of the distal press assembly 10 shown in FIG. 3. To attach the top cap 15 to the metallic heating component 14, threaded fasteners may pass through apertures 201 and thread into the threaded holes 300 in the metallic heating component 14. The top cap 15 preferably has a rectangular shape and is aligned with the outer edges of the metallic heating component 14.

Figure 6:
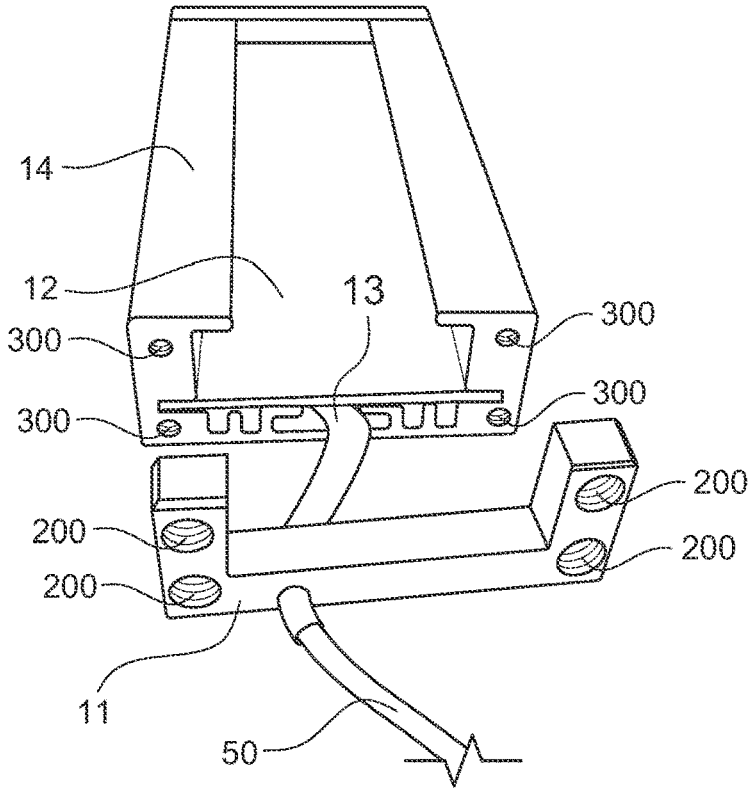
FIG. 6 is a bottom perspective view of the distal press assembly shown in FIG. 3, where the bottom cap has been removed.

FIG. 6 is a bottom perspective view of the distal press assembly 10 shown in FIG. 3, where the bottom cap 11 has been removed. As noted above, the intermediary electrical conductor 50 may pass through the bottom cap 11 prior to being electrically connected to the heating element 13.

Figure 7:
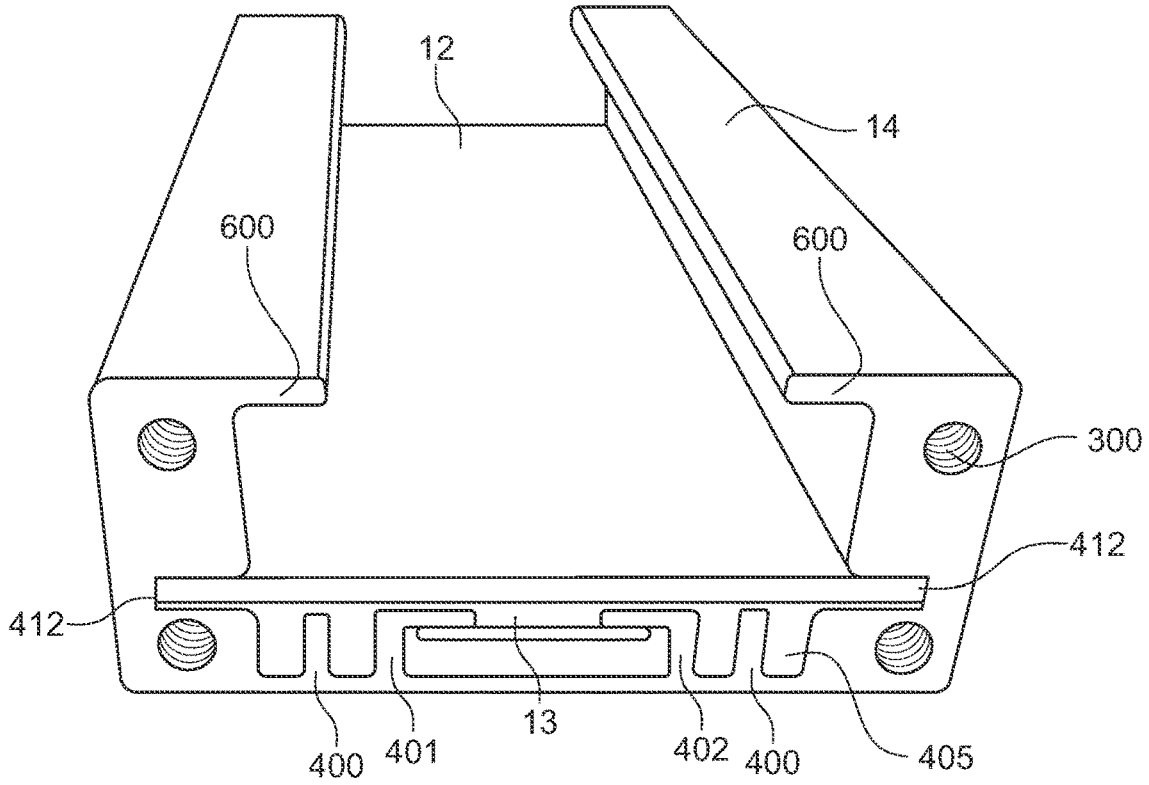
FIG. 7 is a top perspective view of the distal press assembly shown in FIG. 3, where the top cap has been removed.

FIG. 7 is a top perspective view of the distal press assembly 10 shown in FIG. 3, where the top cap 15 has been removed. The insulating plate 12 is preferably located within a pair of notches 412 that run substantially the entire length of the metallic heating component 14. A channel 405 is preferably created between the insulating plate 12 and the interior wall of the metallic heating component 14. Within a central portion of this channel are a first 401 and second 402 L-shaped ribs which run substantially the entire length of the metallic heating component 14, where the heating element 13 is placed between the ribs 401/402 and the interior wall of the metallic heating component 14. Preferably at least a portion of the ribs 401/402 is located between the heating element 13 and the insulating plate 12. Preferably, the ribs 401/402 are positioned substantially parallel to the axis 19 while also being positioned generally symmetrical about the axis 19.

When viewing the metallic heating component 14/24 in the upright U-shaped position as shown in FIG. 7, it can also be described by saying that the insulating plate 12/22 is preferably placed above the heating element 13/23. Also in this orientation, it can be described by saying that the ribs 400 extend upwardly from the bottom interior surface of the U-shape metallic heating component 14/24. The ribs 401/402 also extend upwardly, until turning approximately 90 degrees towards the central axis 19 to form their L-shaped cross-sectional shape.

Also shown here are the ledges 600 which extend inwardly from the upper portion of the U-shape and substantially horizontally towards the central axis 19. The ledges 600 are preferably substantially perpendicular to the vertical portions of the U-shaped metallic heating component 14/24. The ledges 600 may be used on both metallic heating components 14/24 or only one.

A pair of rectangular ribs 400 are also preferably placed in the channel 405 created between the insulating plate 12 and the interior wall of the metallic heating component 14 and also travel substantially the entire length of the metallic heating component 14. The height of the rectangular ribs 400 are preferably the same as the height of the L-shaped ribs 401/402 (i.e. the distance that the element extends perpendicularly from the interior wall of the metallic heating component 14 towards the insulating plate 12). Preferably, the ribs 400 run substantially parallel to the axis 19 while also being positioned generally symmetrical about the axis 19.

Figure 8:
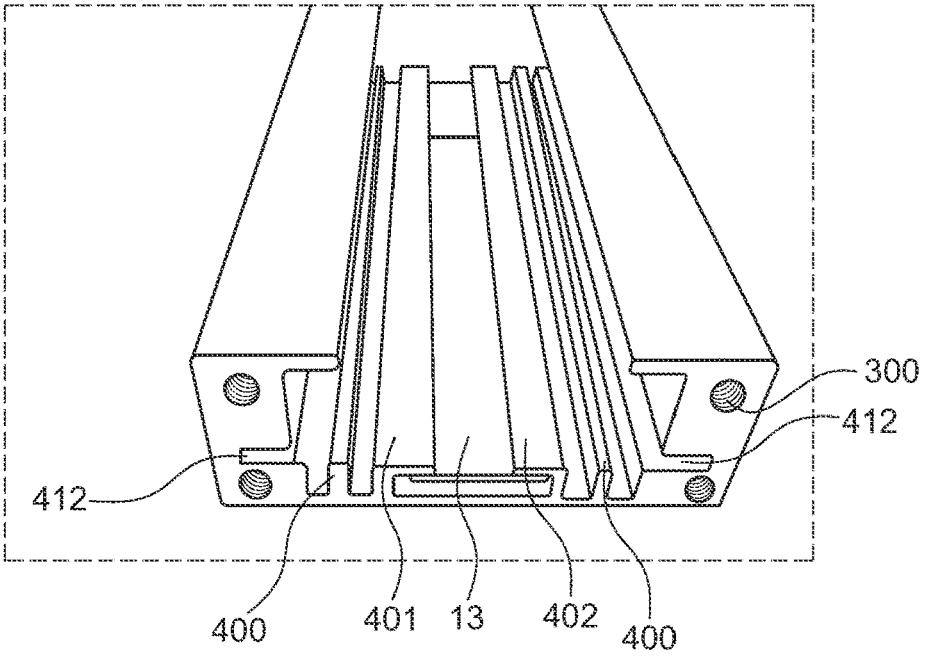
FIG. 8 is a top perspective view of the distal press assembly shown in FIG. 3, where the top cap and insulation plate have been removed.

FIG. 8 is a top perspective view of the distal press assembly shown in FIG. 3, where the top cap 15 and insulation plate 12 have been removed.

Figure 9:
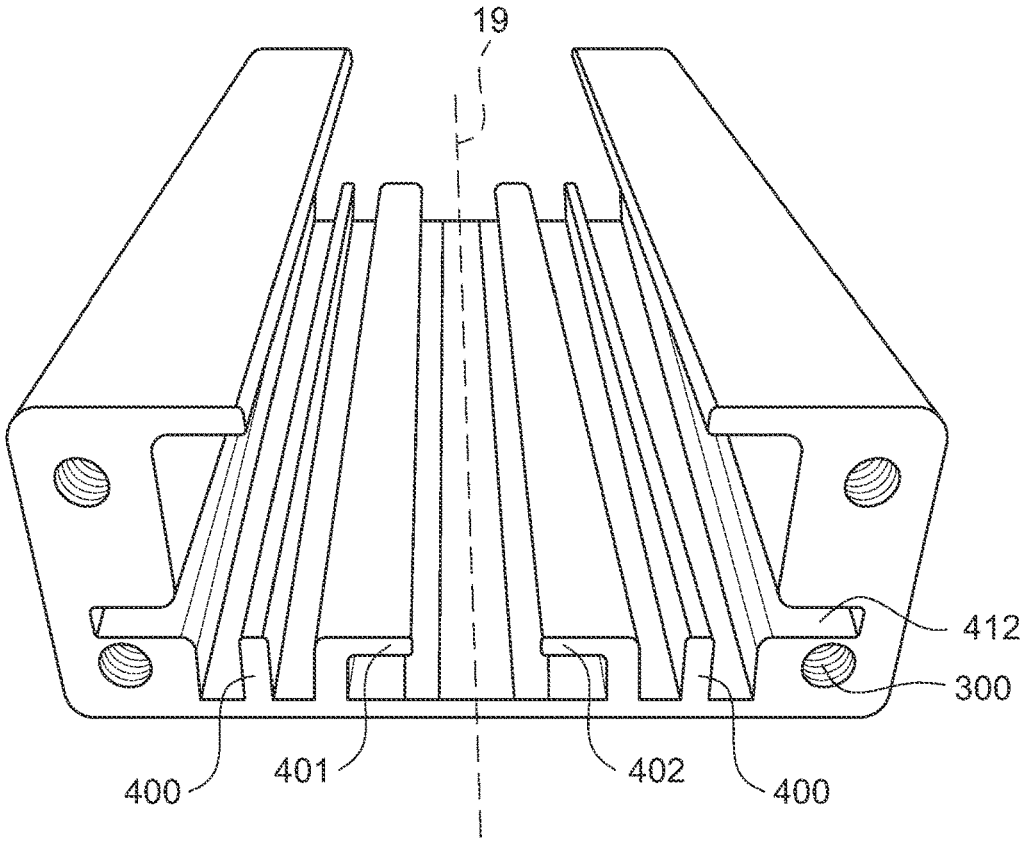
FIG. 9 is a top perspective view of the metallic heating component for the distal press assembly.

FIG. 9 is a top perspective view of the metallic heating component 14 for the distal press assembly 10.

Figure 10:
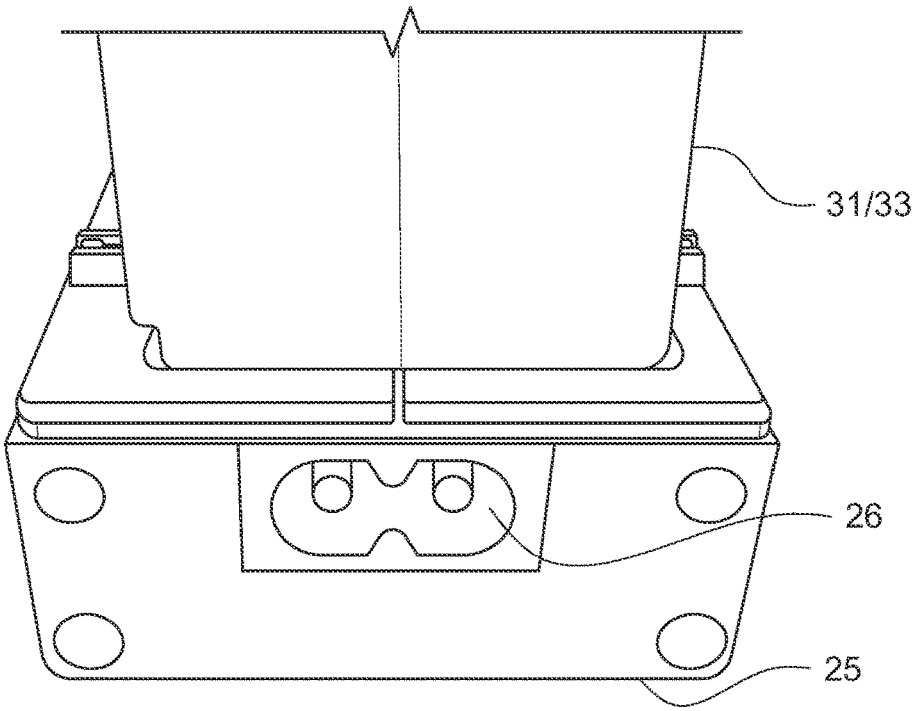
FIG. 10 is a top perspective view of an exemplary embodiment of the proximal press assembly and housing.

FIG. 10 is a top perspective view of an exemplary embodiment of the proximal press assembly 20 and assembly 30.

Figure 11:
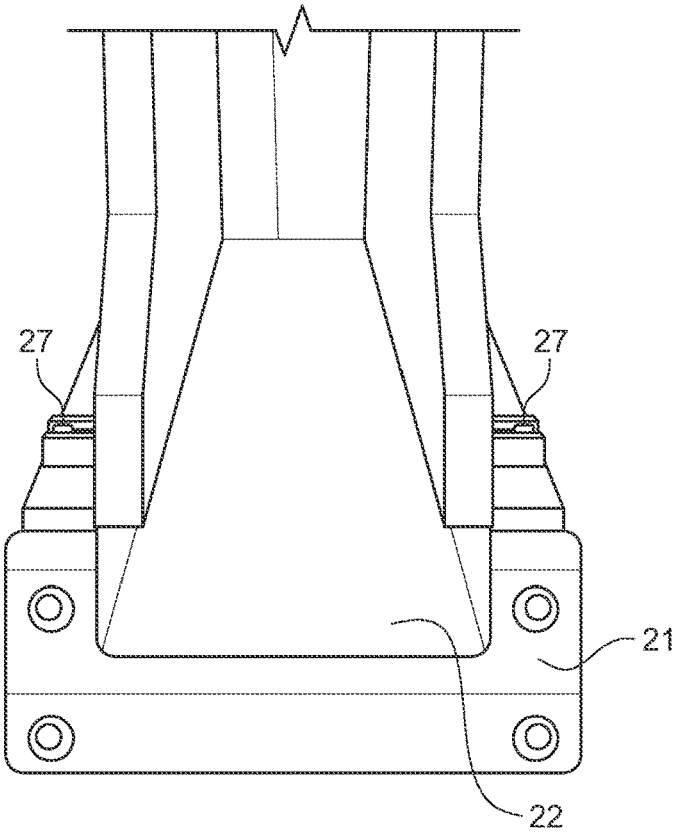
FIG. 11 is a bottom perspective view of an exemplary embodiment of the proximal press assembly and proximal block assembly.

FIG. 11 is a bottom perspective view of an exemplary embodiment of the proximal press assembly 20 and assembly 30. Here we see the open bottom which permits the two components to be fully assembled and simply slide over the top of the proximal block 120 portion of the base device 100, as will be discussed further below. The bottom cap 21 is generally shaped similar to bottom cap 11 and is attached to metallic heating component 24 similar to the bottom cap 11 attachment to the metallic heating component 14 described above.

Figure 12:
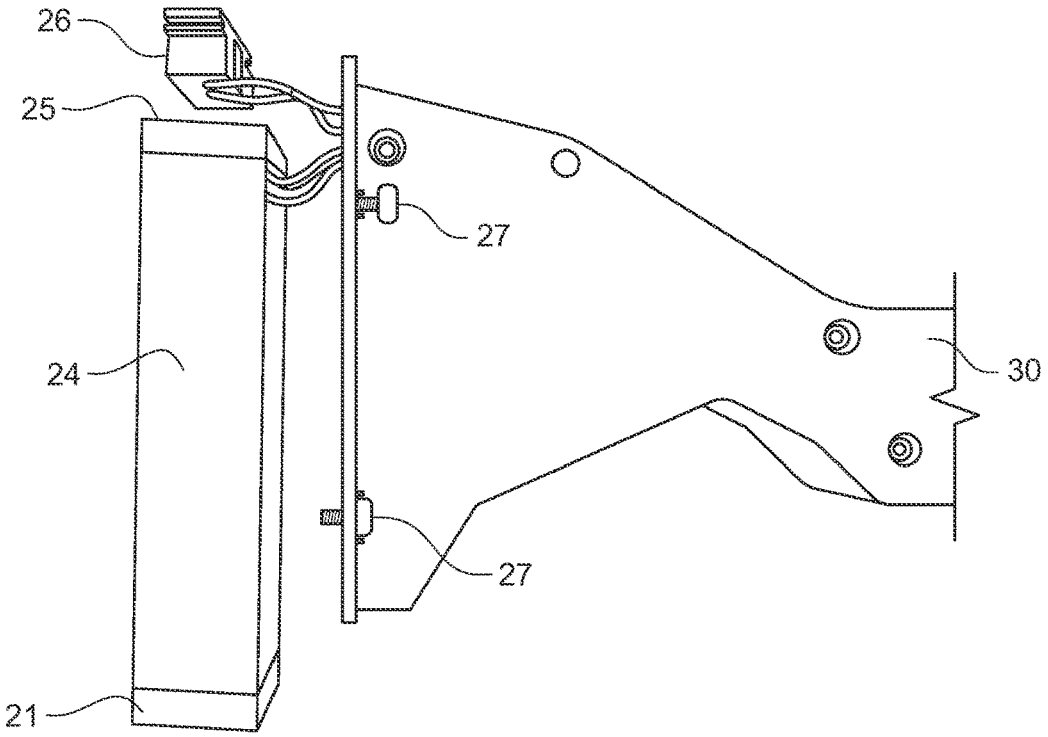
FIG. 12 is a front elevation view of an exemplary embodiment of the proximal press assembly and proximal block housing assembly where the intermediary power connector has been detached from the metallic heating component and the proximal block housing assembly has been detached from the metallic heating component.

FIG. 12 is a front elevation view of an exemplary embodiment of the proximal press assembly 20 and proximal block assembly 30 where the intermediary power connector 26 has been detached from the metallic heating component 24 and the proximal block assembly 30 has been detached from the metallic heating component 24. The metallic heating component 24 preferably contains a set of threaded holes which are generally perpendicular to axis 29 and accept the threaded fasteners 27 which pass through apertures on the left and right sides 31/33 of the housing in order to attach the proximal block assembly 30 to the proximal press assembly 20.

Figure 13:
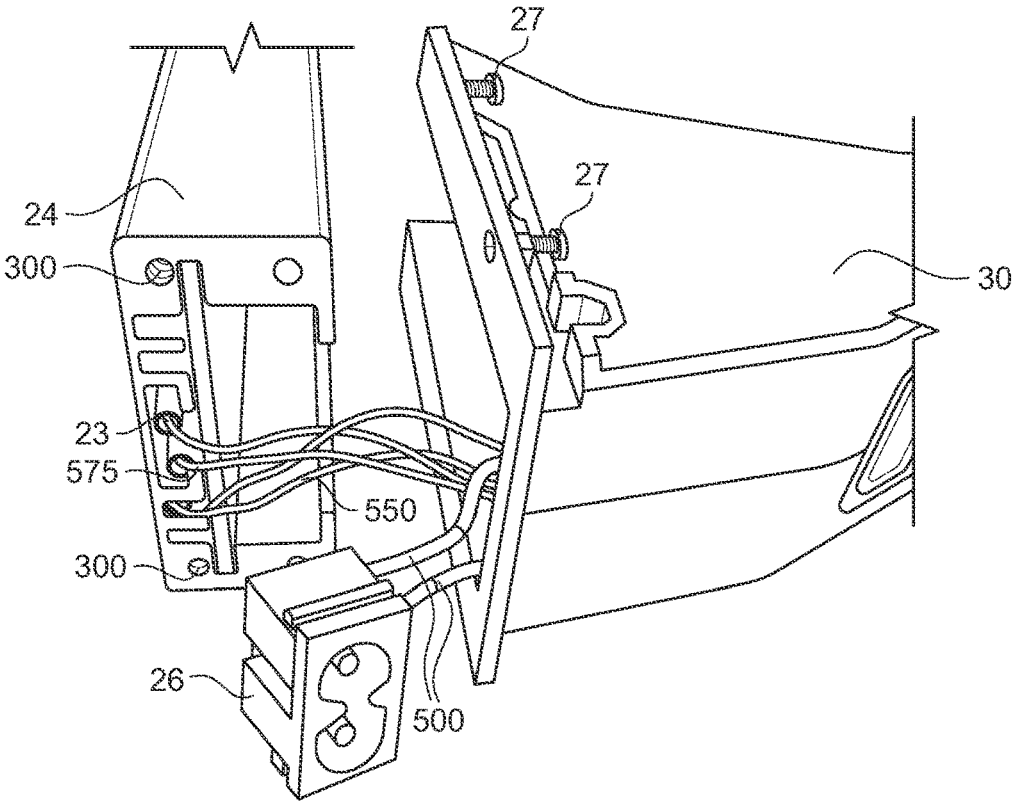
FIG. 13 is a top perspective view of the exemplary embodiment of the proximal press assembly from FIG. 12, where the top cap has been removed.

FIG. 13 is a top perspective view of the exemplary embodiment of the proximal press assembly 20 from FIG. 12, where the top cap 25 has been removed. Electrical conductors 500 are preferably connected with the PCB 36 and exit the assembly 30 prior to entering the proximal press assembly 20 and electrically connecting with the intermediary power connector 26. A thermocouple 550 is also preferably connected with the PCB 36 and exits the assembly 30 prior to entering the channel 405. The thermocouple 550 is preferably located between the rectangular rib 400 and one of the L-shaped ribs 401/402 and extends to a point near the mid-point of the metallic heating component 24.

Electrical conductors 575 are preferably connected with the PCB 36 and exit the assembly 30 prior to entering the proximal press assembly 20 and electrically connecting with the heating element 23.

Figure 14:
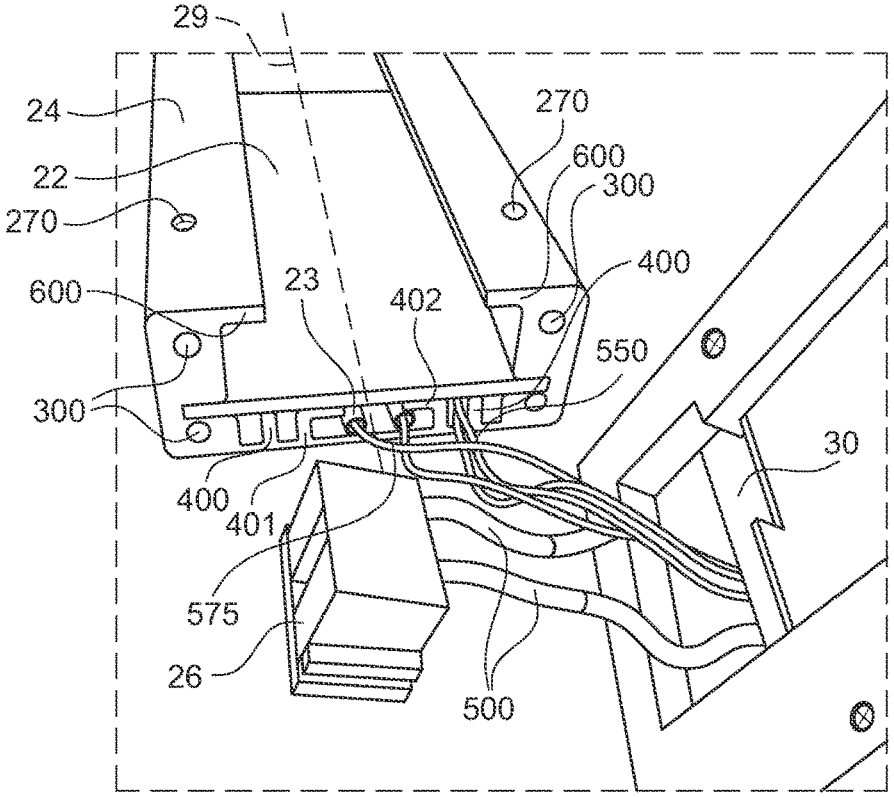
FIG. 14 is a top perspective view of the exemplary embodiment of the proximal press assembly from FIG. 12, where the top cap has been removed.

FIG. 14 is a top perspective view of the exemplary embodiment of the proximal press assembly 20 from FIG. 12, where the top cap 25 has been removed. As shown, the metallic heating component 24 contains a pair of L shaped ribs 401/402 as well as a pair of rectangular ribs 400, positioned generally symmetrically about the central axis 29 similar to the ribs 400/401/402 described above with respect to the metallic heating component 14. It should be noted that the metallic heating component 24 preferably contains a plurality of threaded holes 270 which are substantially perpendicular to the axis 29 and accepts a threaded fastener 27 which passes through a portion of the assembly 30, in order to attach the proximal block assembly 30 to the metallic heating component 14.

Also shown here are the ledges 600 which extend inwardly from the upper portion of the U-shape and substantially horizontally towards the central axis 29. The ledges 600 are preferably substantially perpendicular to the vertical portions of the U-shaped metallic heating component 14/24. The ledges 600 may be used on both metallic heating components 12/24 or only one.

Figure 15:
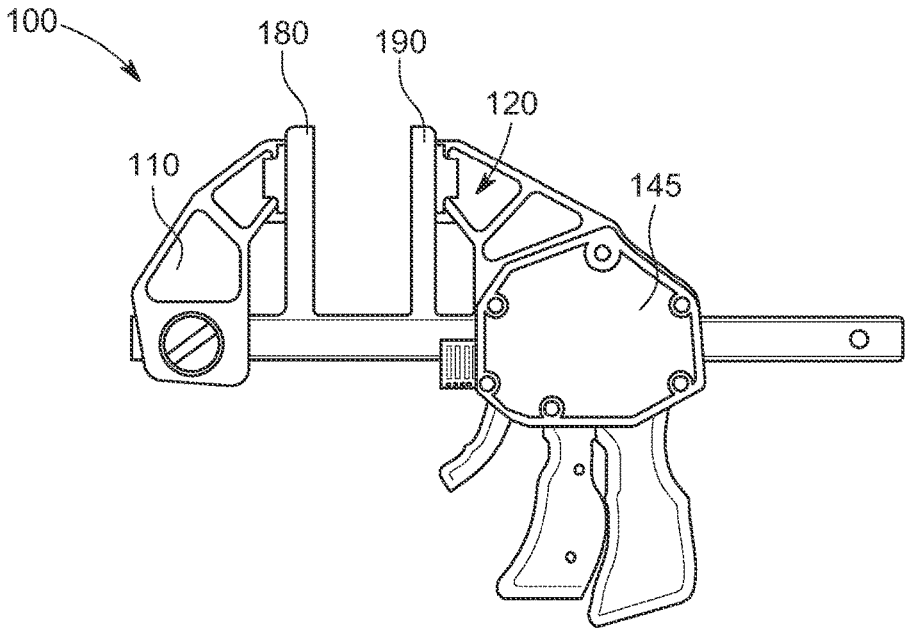
FIG. 15 is a front elevation view of an exemplary base clamp device.

FIG. 15 is a front elevation view of an exemplary base clamp device 100. As noted above, a distal block 110 preferably moves relative to a proximal block 120. Here, the distal block 110 contains a substantially flat rectangular element 180 which extends from the distal block 110. Similarly, a substantially flat rectangular element 190 also preferably extends from the proximal block 120. As will be shown below, the exemplary system allows the distal press assembly 10 to slide atop the rectangular element 180 while the proximal press assembly 20 can slide atop the rectangular element 190.

In some embodiments, the base device includes a pair of substantially flat rectangular elements 180/190 that can be used with the modular press assembly components shown and described herein. In some cases, a replacement set of substantially flat rectangular elements 180/190 may be supplied which may (1) provide different physical dimensions for better mechanical engagement with the distal and proximal press assemblies 10/20 and/or (2) provide different materials such as materials which are stable at higher temperatures (ex. silicone or similar).

It should also be noted that base device 100 is only provided as an example, and many embodiments of the modular rosin press components described herein would work with other base devices. All that is required is a distal block which moves relative to a proximal block. The specific geometry of the distal block 110, proximal block 120, rectangular elements 180/190, clamping mechanism 145, trigger 130, locking lever 135, and beam 140 may vary across different embodiments of the base device, but would still work with various embodiments of the modular rosin press components described herein.

Figure 16:
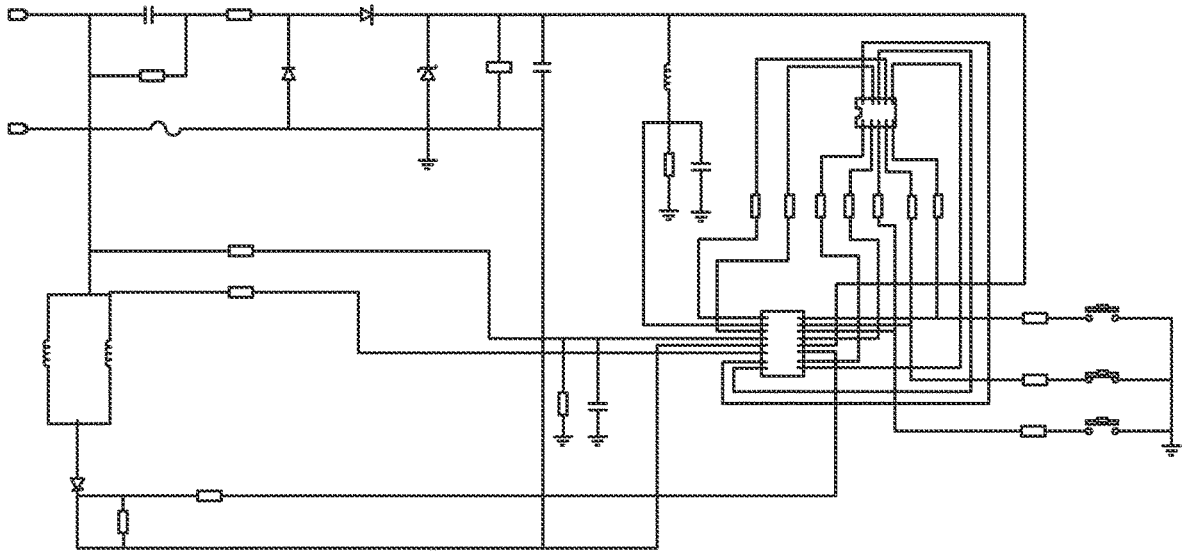
FIG. 16 is an electrical schematic for an exemplary embodiment of the modular rosin press components.

FIG. 16 is an electrical schematic for an exemplary embodiment of the modular rosin press components. It should be stated that this is simply an example of one schematic for operating the device, as many different types of electrical schematics could be used to operate various embodiments of the invention.

Figure 17A:
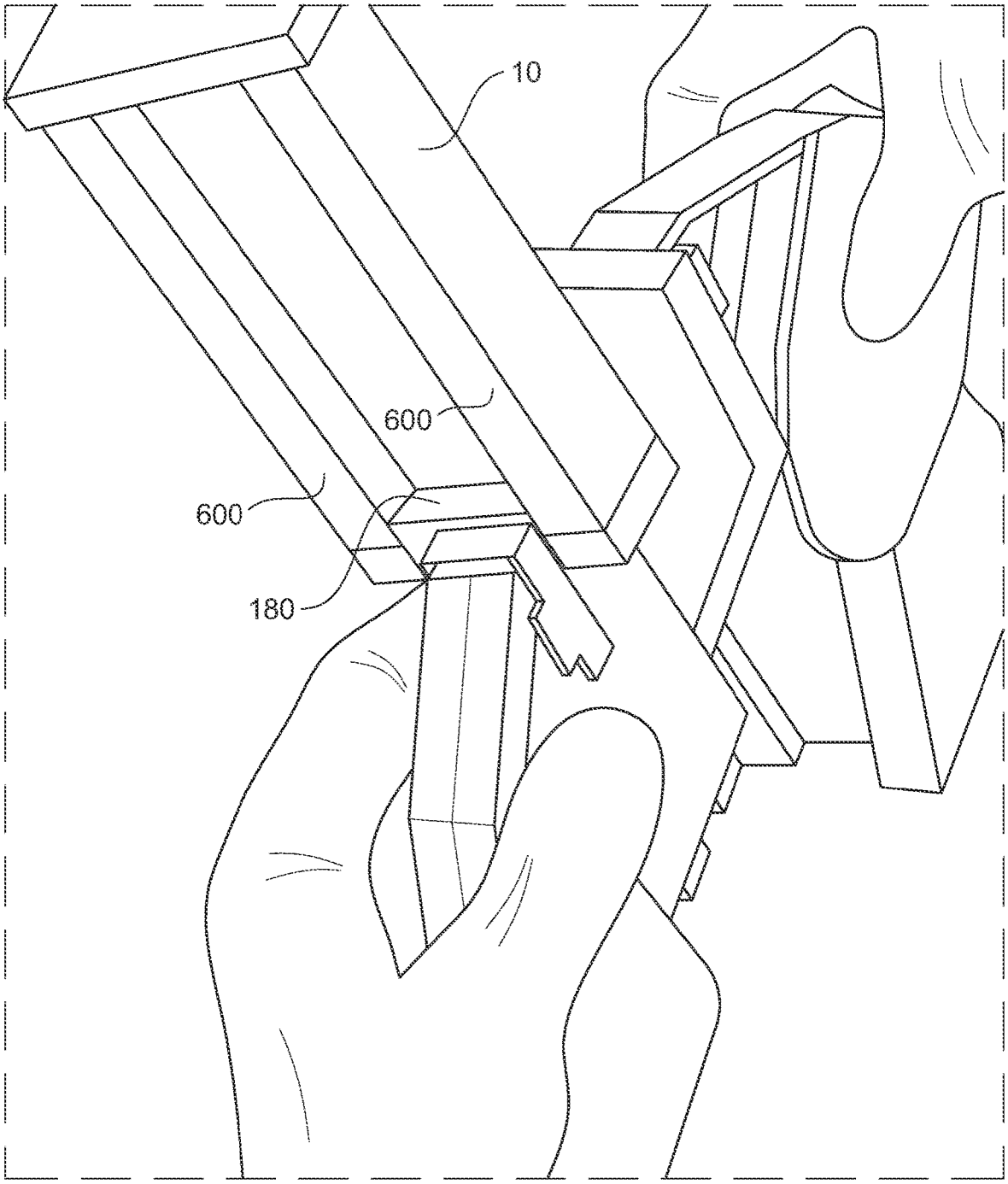
FIG. 17A-17B are illustrations of the distal press assembly being installed onto a base device.
Figure 17B:
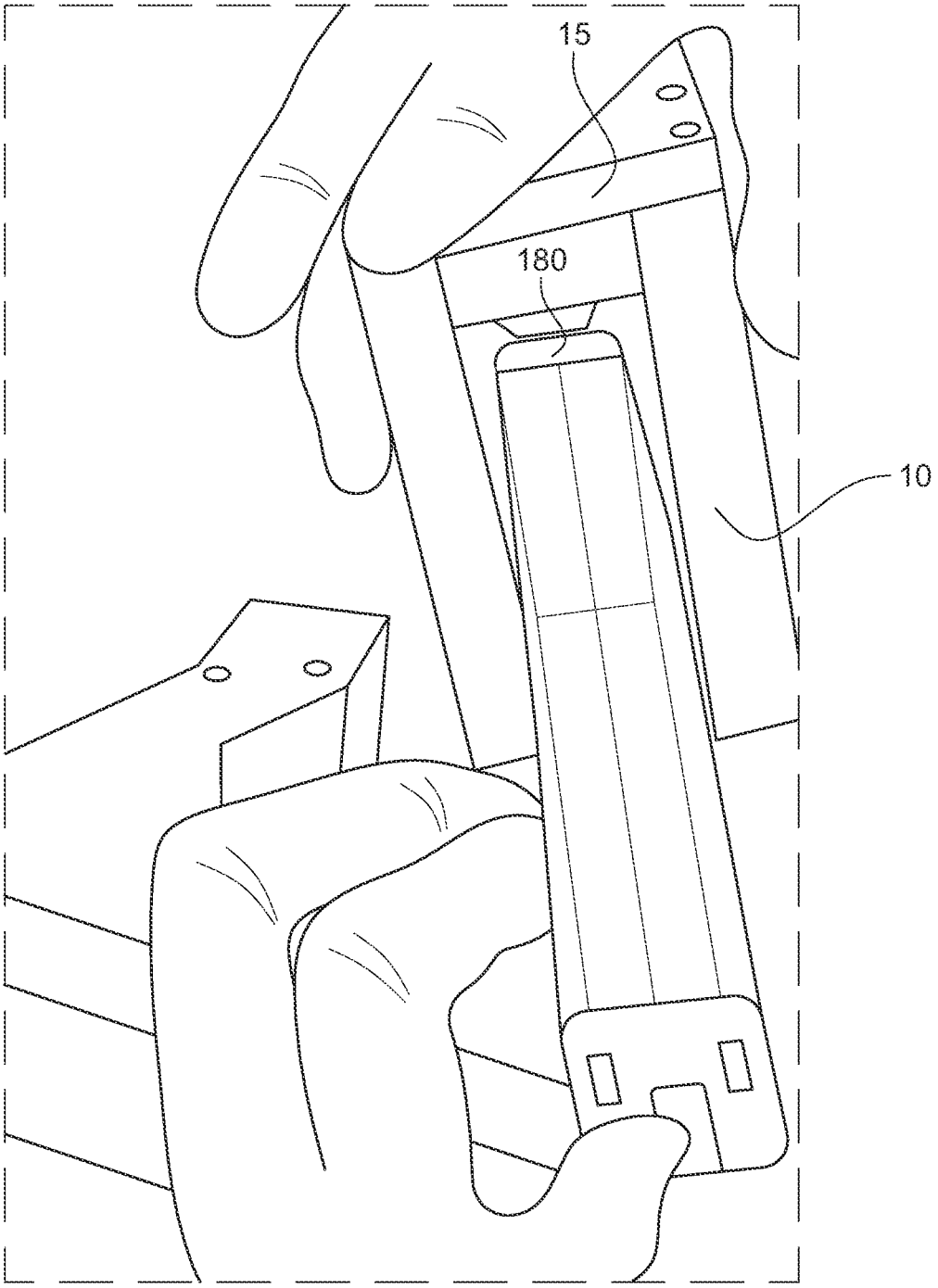

FIG. 17A-17B are illustrations of the distal press assembly 10 being installed onto a base device 100. Here, we see the distal press assembly 10 sliding vertically down on to the element 180. In this way, the element 180 of the base device 100 travels along the central channel of the distal press assembly 10 (along the axis 19) until contacting (or nearly contacting) the top plate 15. In this way, it could also be said that the bottom plate 11 contains a U-shape that is similar to the cross-sectional shape of the substantially flat rectangular element 180, which allows the element 180 to pass through the bottom plate 11. The ledges 600 may be sized and positioned so as to cover a portion of the element 180 to secure the distal press assembly 10 onto the element 180. In other words, in an exemplary embodiment the width of the element 180 should preferably be similar to the distance between the insulating plate 12/22 and the ledge 600.

Figure 17C:
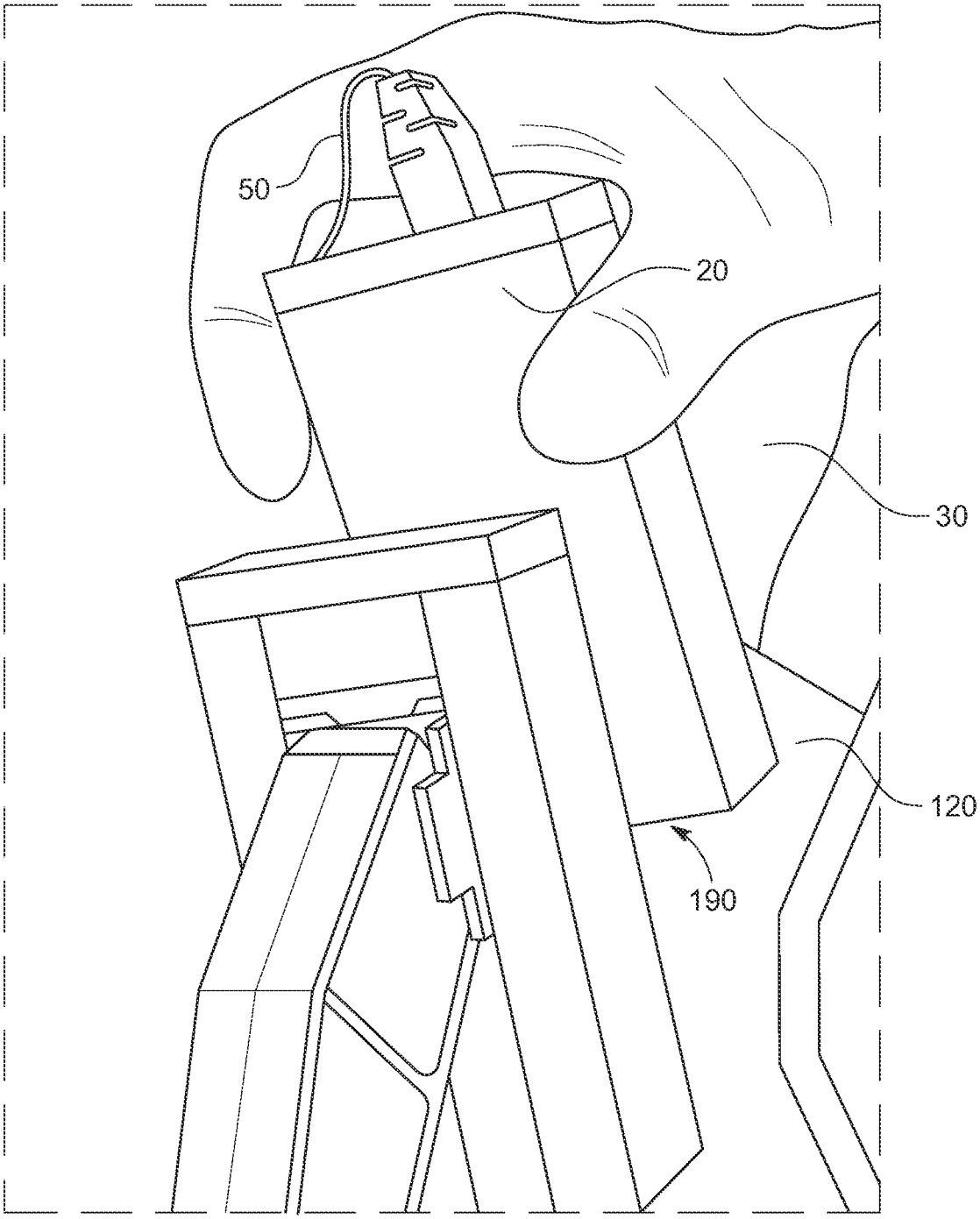
FIG. 17C is an illustration of the proximal press assembly and housing being installed onto a base device.

FIG. 17C is an illustration of the proximal press assembly 20 and proximal block assembly 30 being installed onto a base device 100. Here, we see the proximal press assembly 20 sliding vertically down on to the element 190. In this way, the element 190 of the base device 100 travels along the central channel of the proximal press assembly 20 (along the axis 29) until contacting (or nearly contacting) the top plate 25. In this way, it could also be said that the bottom plate 21 contains a U-shaped opening that is similar to the cross-sectional shape of the substantially flat rectangular element 190, which allows the element 190 to pass through the bottom plate 21. The housing 31/33 also contains an opening on the bottom which is sized to accept the proximal block portion 120 of the base device 100. In other words, the proximal press assembly 20 and proximal block assembly 30 are preferably attached to one another so that they slide together as a single unitary piece atop the element 190 and proximal block 120 of the base device 100.

Figure 18A:
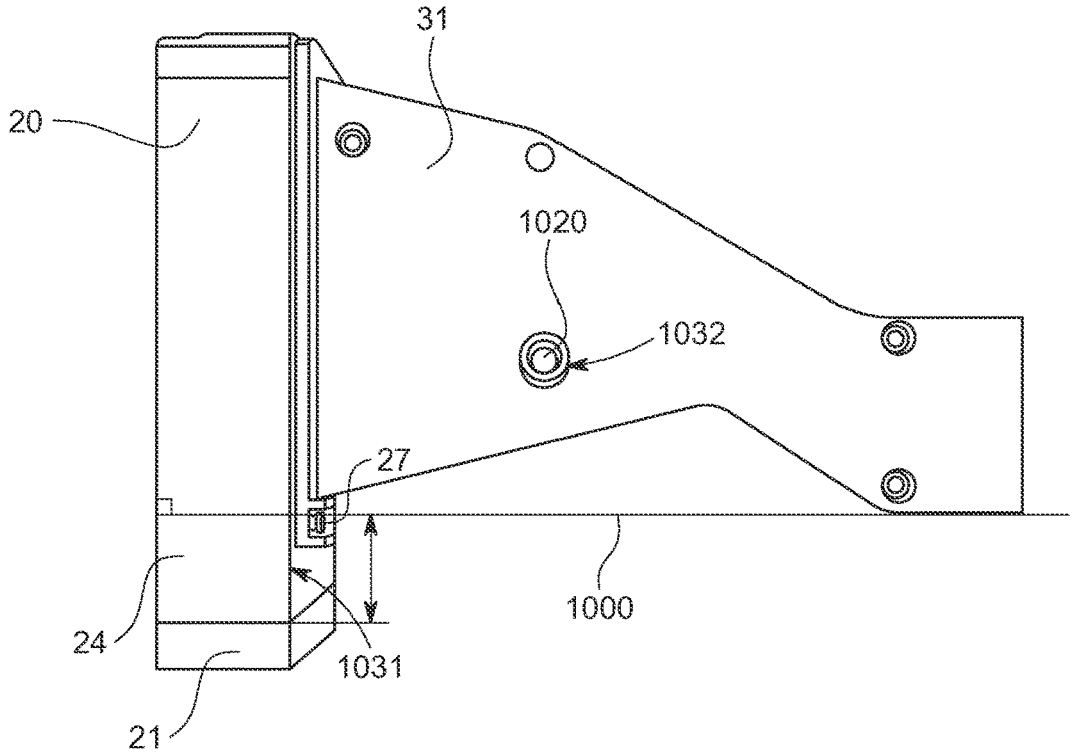
FIG. 18A is a front elevation view of another embodiment of the proximal press assembly, where the proximal press assembly contains an optional extended portion along with an optional securing screw.

FIG. 18A is a front elevation view of another embodiment of the proximal press assembly 20, where the proximal press assembly 20 contains an optional extended portion 1031 which extends below the fastener 27 and bottom edge (lowest point) of left housing 31. This embodiment could also be described as having a cutout in the left/right housing 31/33 so that the proximal press assembly 20 extends lower than the lowest edge of the left/right housing 31/33. This embodiment also includes an optional securing screw 1020 which passes through a threaded hole 1032 in the left housing 31 such that rotation of the screw 1020 causes it to travel towards/away from the proximal block 120 of the base device 100. In this way, the screw 1020 can further secure the base device 100 within the housing 31/33 by contacting the screw 1020 with the proximal block 120.

Figure 18B:
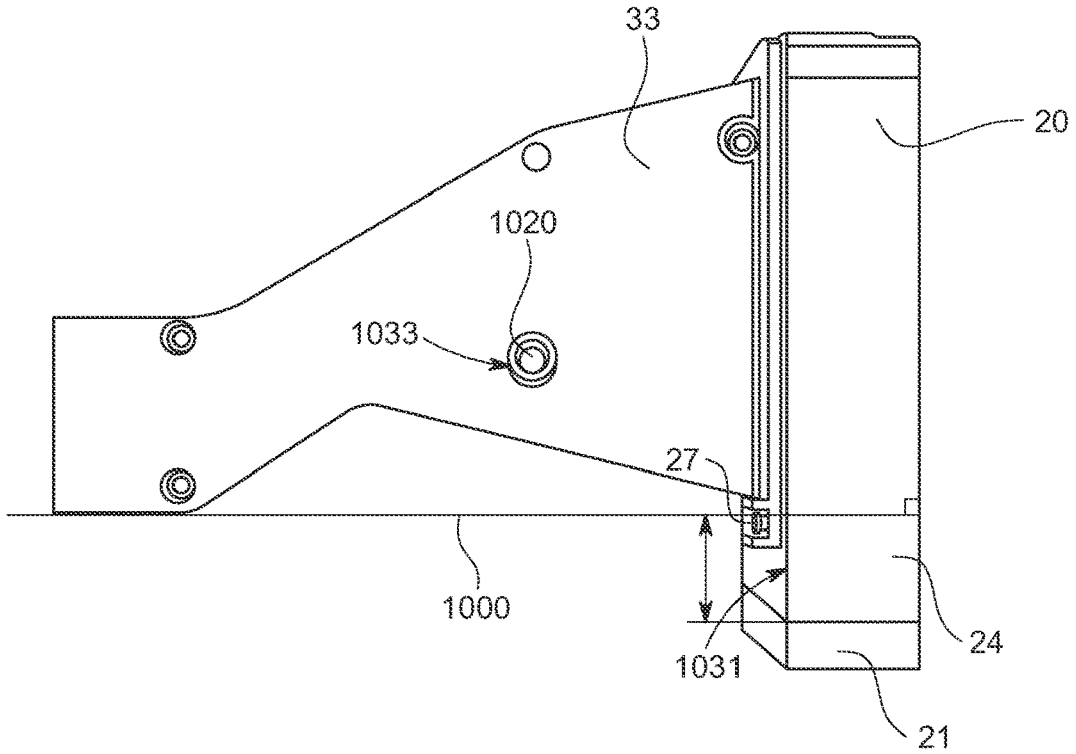
FIG. 18B is a rear elevation view of another embodiment of the proximal press assembly, where the proximal press assembly contains an optional extended portion along with an optional securing screw.

FIG. 18B is a rear elevation view of another embodiment of the proximal press assembly 20, where the proximal press assembly 20 contains an optional extended portion 1031 which extends below the fastener 27 and bottom edge (lowest point) of left housing 31. This embodiment could also be described as having a cutout in the left/right housing 31/33 so that the proximal press assembly 20 extends lower than the lowest edge of the left/right housing 31/33. This embodiment also includes an optional securing screw 1020 which passes through a threaded hole 1033 in the right housing 33 such that rotation of the screw 1020 causes it to travel towards/away from the proximal block 120 of the base device 100. In this way, the screw 1020 can further secure the base device 100 within the housing 31/33 by contacting the screw 1020 with the proximal block 120.

As shown in this embodiment, the proximal press assembly 20 extends lower than the lowest point on the housing 31/33, when viewed from a horizontal line 1000 that is generally perpendicular to the vertical edge of the metallic heating component 24. The horizontal line 1000 also preferably passes through the fastener 27.

It should be noted that the metallic heating components 14 and 24 are substantially the same, with the only major difference being the threaded holes 270 which are substantially perpendicular to the axes 19/29 (found on the heating element 24 only). The components 14 and 24 are preferably an extruded metal but could also be produced through milling (or other machining) or 3D printing. The metal used would preferably be non-corrosive, such as aluminum, stainless steel, or similar. The metal used could be a pure metal, or could be mixed with other metals, carbon, fillers, or other substances. In a preferred embodiment, the ribs 400-402 and ledges 600 extend from the base geometry of the U-shaped metallic heating components 14/24 as a single unitary piece and/or part of the same extrusion, forming, or machining process. In other words, the ribs 400-402 and ledges 600 are preferably metallic and substantially monolithic with the remaining geometry of the metallic heating components 14/24.

The exemplary embodiments herein allow the modular rosin press components to be easily installed on a base device 100, while permitting the base device 100 to be replaced while continuing to use the same module rosin press components. Also, individual pieces of the assembly can be removed/replaced one at a time as each part fails. The exemplary embodiments permit use of the device with only one hand, making processing oils and concentrates much easier, especially when working alone.

The insulating plate 22 can be comprised of any material with low thermal conductivity, and preferably a low electrical conductivity as well. In an exemplary embodiment, the insulating plate 22 would be comprised of a thermosetting phenol formaldehyde resin, formed from a condensation reaction of phenol with formaldehyde, generally known as Bakelite or similar. Other embodiments of the plate 22 may comprise fiberglass composites, G10, high-pressure fiberglass laminates, or similar.

Having shown and described a preferred embodiment of the invention, those skilled in the art will realize that many variations and modifications may be made to affect the described invention and still be within the scope of the claimed invention. Additionally, many of the elements indicated above may be altered or replaced by different elements which will provide the same result and fall within the spirit of the claimed invention. It is the intention, therefore, to limit the invention only as indicated by the scope of the claims.

I claim:

1. A modular rosin press device comprising:

a proximal press assembly containing a first metallic heating component with a generally U-shaped cross-section and a first central axis travelling down the center of the U-shaped cross-section, a first rib positioned on the first metallic heating component and positioned substantially parallel to the first central axis on a first side of the first central axis, a second rib positioned on the first metallic heating component and positioned substantially parallel to the first central axis on an opposing side of the first central axis as the first rib, a first heating element positioned between the first and second ribs of the first metallic heating component, a pair of notches formed into a pair of interior walls of the first metallic heating component, and a first flat insulating plate positioned within the pair of notches of the first metallic heating component;

a distal press assembly containing a second metallic heating component with a generally U-shaped cross-section and a second central axis travelling down the center of the U-shaped cross-section, a third rib positioned on the second metallic heating component and positioned substantially parallel to the second central axis on a first side of the second central axis, a fourth rib positioned on the second metallic heating component and positioned substantially parallel to the second central axis on an opposing side of the second central axis as the third rib, a second heating element positioned between the third and fourth ribs of the second metallic heating component, a pair of notches formed into a pair of interior walls of the second metallic heating component, a plurality of threaded holes placed within the second metallic heating component and oriented substantially perpendicular to the second central axis; and a second flat insulating plate positioned within the pair of notches of the second metallic heating component; and an assembly containing a housing with electronic controls for operating the first and second heating elements.

2. The modular device of claim 1 further comprising:

a top cap attached to a top portion of the first metallic heating component and having a generally rectangular shape; and a bottom cap attached to a bottom portion of the first metallic heating component and having a U-shape sized and positioned to align generally with the U-shape of the first metallic heating component.

3. The modular device of claim 1 wherein:

The plurality of threaded holes are sized to engage with threaded fasteners which attach the second metallic heating component to the housing.

4. The modular device of claim 1 further comprising:

a pair of ledges which extend inwardly from a top portion of the first metallic heating component.

5. A modular rosin press device for use with a base clamp device having a proximal block with a rectangular element that moves relative to a distal block also with a rectangular element when a trigger is squeezed, the modular rosin press device comprising:

a proximal press assembly containing a first metallic heating component with a generally U-shaped cross-section and first central axis travelling down the center of the U-shaped cross-section where the U-shaped cross-section is sized to allow the rectangular element of the proximal block to slide along the first central axis and inside the U-shaped cross-section, a first heating element, and a first pair of ribs which surround the first heating element;

a distal press assembly containing a second metallic heating component with a generally U-shaped cross-section and second central axis travelling down the center of the U-shaped cross-section where the U-shaped cross-section is sized to allow the rectangular element of the distal block to slide along the second central axis and inside the U-shaped cross-section, a second heating element, a second pair of ribs which surround the second heating element; and an assembly containing a housing with electronic controls for operating the first and second heating elements.

6. The modular device of claim 5 further comprising:

a first pair of ledges which extend inwardly towards the first central axis; and a second pair of ledges which extend inwardly towards the second central axis.

7. The modular device of claim 5 wherein:

the distal press assembly moves when the trigger is squeezed.

8. The modular device of claim 5 further comprising:

a plurality of threaded holes placed within the second metallic heating component and oriented substantially perpendicular to the second central axis.

9. The modular device of claim 5 wherein:

the proximal press assembly and the distal press assembly translate relative to each other.

10. The modular device of claim 5 wherein:

the proximal press assembly and the distal press assembly are parallel to each other during opening and closing of the clamp.

* * * * *